United States Patent [19]

Gross

[11] Patent Number: 4,887,080

[45] Date of Patent: Dec. 12, 1989

[54] STATIONARY TRAFFIC MONITORING DEVICE

[75] Inventor: Mario Gross, Düsseldorf, Fed. Rep. of Germany

[73] Assignee: Robot Foto und Electronic GmbH U. Co. KG, Dusseldorf, Fed. Rep. of Germany

[21] Appl. No.: 231,158

[22] Filed: Aug. 11, 1988

[30] Foreign Application Priority Data

Aug. 18, 1987 [DE] Fed. Rep. of Germany ..... 3727503

[51] Int. Cl.[4] ..... G08G 1/10

[52] U.S. Cl. ..... 340/937; 346/107 VP; 358/108

[58] Field of Search ..... 340/937, 941, 936, 939; 364/436; 358/108, 210; 346/107 VP

[56] References Cited

FOREIGN PATENT DOCUMENTS 2356909 5/1975 Fed. Rep. of Germany ..... 340/937

945693 1/1964 United Kingdom ..... 340/937

OTHER PUBLICATIONS

"Europe Gets 'thinking' Traffic Lights", John Gosch, Electronics, May 1, 1975, pp. 70–71.

"Smile! You Just Got a Ticket", Michael Lamm, Popular Mechanics, Dec. 1969, pp. 73–76.

Philips Intersection Controller Type 86 AD182, Philips Telecommunications Review, vol. 33, No. 1, Mar. 1975, pp. 1–8.

*Primary Examiner*—Joseph A. Orsino

*Assistant Examiner*—Hollis T. Chen

*Attorney, Agent, or Firm*—Lee, Mann, Smith, McWilliams & Sweeney

[57] ABSTRACT

In a stationary traffic monitoring device a housing is fixedly installed at a place of operation. An insert having a recording camera and control and evaluation unit is adapted to be optionally inserted into the housing. The data specific for the operation site, for example identification sign of the operation site, switch-off times or the delay times required for the operation site, are memorized in a housing-fixed memory and are automatically transferred to the control and evaluation unit when the insert is inserted into the housing.

5 Claims, 5 Drawing Sheets

STATIONARY TRAFFIC MONITORING DEVICE

TECHNICAL FILED

The invention relates to a stationary traffic monitoring device comprising a housing fixedly installed at the operation site, and an insert having a recording camera and a control and evaluation unit adapted to receive data specific for the operation site.

The traffic monitoring device can be a "red light monitoring device" for monitoring a road intersection controlled by traffic light or, for example, a speed monitoring device having Doppler radar, by means of which exceeding of an allowed maximum speed limit is detected. The recording camera can be a photographic camera. However, it can also, for example, be an electronic camera, e.g. a video camera, in which the picture is electronically recorded and memorized.

BACKGROUND ART

Devices for photographically monitoring road intersections controlled by traffic lights are known (German Auslegeschrift No. 1,078,797). Such devices shall detect vehicles entering the road intersection during the stop phase in a manner able to identify them. To this end a sensor in the form of an induction loop is imbedded in the road carpet of the monitored road just before the junction with the road intersection. The sensor responds to a vehicle driven thereover and supplies a sensor signal. A further signal is received at the traffic light when the traffic light changes to the stop phase. A photographic camera is released by a control and evaluation unit when a sensor signal occurs during the stop phase, which is the case when a vehicle enters the road intersection during the stop phase. The camera supplies a picture in which the vehicle in the road intersection and the traffic light showing "red" can be seen. In the picture also the licence number can be seen such that the vehicle can be identified. In order to increase the evidential value several pictures are usually taken one after the other at fixed time intervals (German Pat. No. 2,365,331).

These devices do not just serve to determine violation of traffic regulations but they also act to prevent such violations. To this end, devices for red light monitoring have to be installed in the municipal area at a number of road intersections controlled by traffic lights. This would be very expensive for the installation of the devices as well as for the evaluation of the pictures taken therewith. For this reason, traffic monitoring devices are often made of two parts: They have components fixedly installed at the operation site and an insert adapted to be inserted at different places of operation. The stationary components fixedly installed are the sensor imbedded in the road carpet and a housing usually arranged on a support, the sensor being connected to plugs in the housing through fixedly imbedded lines. The insert comprises the photographic camera, a flash device, and a control and evaluation unit which controls the course of operation and couples the signals obtained from the sensor and from the traffic light for releasing or not releasing the camera. Therewith, at different places of operation, an insert can be inserted for random periods of time in the housing in question. Then the car driver does not know in which housing an insert having camera, flash device, and control and evaluation unit is inserted, i.e. which device is in operation.

There are often different conditions at the different places of operation. These conditions have to be taken into account in the course of operation of the device. The "yellow phases" before the stop phases "red" can, for example, have different durations. The spatial dimensions of road intersections and the position of the sensors relative to the road intersections can be different, which requires different regulations of the delay times for different places of operation. For the purpose of registration, an identification sign or a designation of the operation site has to be input on or with the pictures. Furthermore, in many cases, the operation site has particular characteristics. The position of the sun, for example, can be disadvantageous at certain moments, such that it is not possible to take any useful pictures. In this case it is necessary to switch-off the device during this period of time in order to avoid an unnecessary film consumption. To this end, possibilities of adjustment are provided at devices for monitoring road intersections controlled by traffic lights. By means of these possibilities of adjustment, the police officer manually inputs the parameters specific for the operation site in question.

Where such a manual input is involved, it requires special attention. Therefore the risk of incorrect input of the data is present. Incorrect input of the data reduces the evidential value of the picture. Incorrect input of the switch-off moments leads to unnecessary film consumption and reduces the duration of operation, during which, in fact, monitoring takes place. Furthermore, speed monitoring devices operating with Doppler radar are known. With these devices a radar beam is generated by means of a radar antenna. The speed of the vehicle is determined from the frequency shift obtained due to the Doppler effect when the radar beam is reflected from a moving vehicle. The speed thus determined is compared with a predetermined maximum speed limit. If this maximum speed limit is exceeded, a camera is released and a picture of the vehicle is taken permitting identification of the vehicle (Swiss Pat. No. 414,210).

Also such speed monitoring devices are often used "stationarily" at well determined places of operation. Also herein it is known to fixedly install housings at these places of operation, for example at bridge constructions over expressways, and to form the actual measuring device with the camera and the control as an insert adapted to be optionally inserted into different housings. Also herein it is necessary to adjust at the device the parameters specific for the operation site in question. In particular, the maximum speed limit predetermined at the operation site is one of these parameters.

Furthermore, integrated devices are known having a camera and a control and evaluation unit, which are arranged to be optionally applied for monitoring road intersections controlled by traffic lights and for speed monitoring in fixedly installed housings. In this case, a program specific for the desired mode of operation has to be input in the control and evaluation unit.

DISCLOSURE OF INVENTION

It is the object of the invention to simplify the adaptation to the different places of operation and to avoid adjusting errors in a traffic monitoring device having an insert adapted to be optionally used in different stationary housings.

According to the invention this object is achieved in that the data specific for the operation site are memorized in memory means, said memory means being adapted to transmit said data to the control and evaluation unit when the insert is inserted into the housing.

Thus, nothing has to be adjusted when the insert is changed-over. The parameters are memorized in the housing-fixed memory means. The insert "finds out" from these memory means the identification sign of the operation site, time delays or maximum speed limits or switch-off moments specific for the location. Thus, the handling of the device, when changing operation site, is simplified and accelerated. Incorrect adjustments are eliminated.

BRIEF DESCRIPTION OF THE DRAWINGS

Embodiments of the invention will now be described in greater detail with reference to the accompanying drawings.

BEST MODES OF CARRYING OUT THE INVENTION

Figure 1:
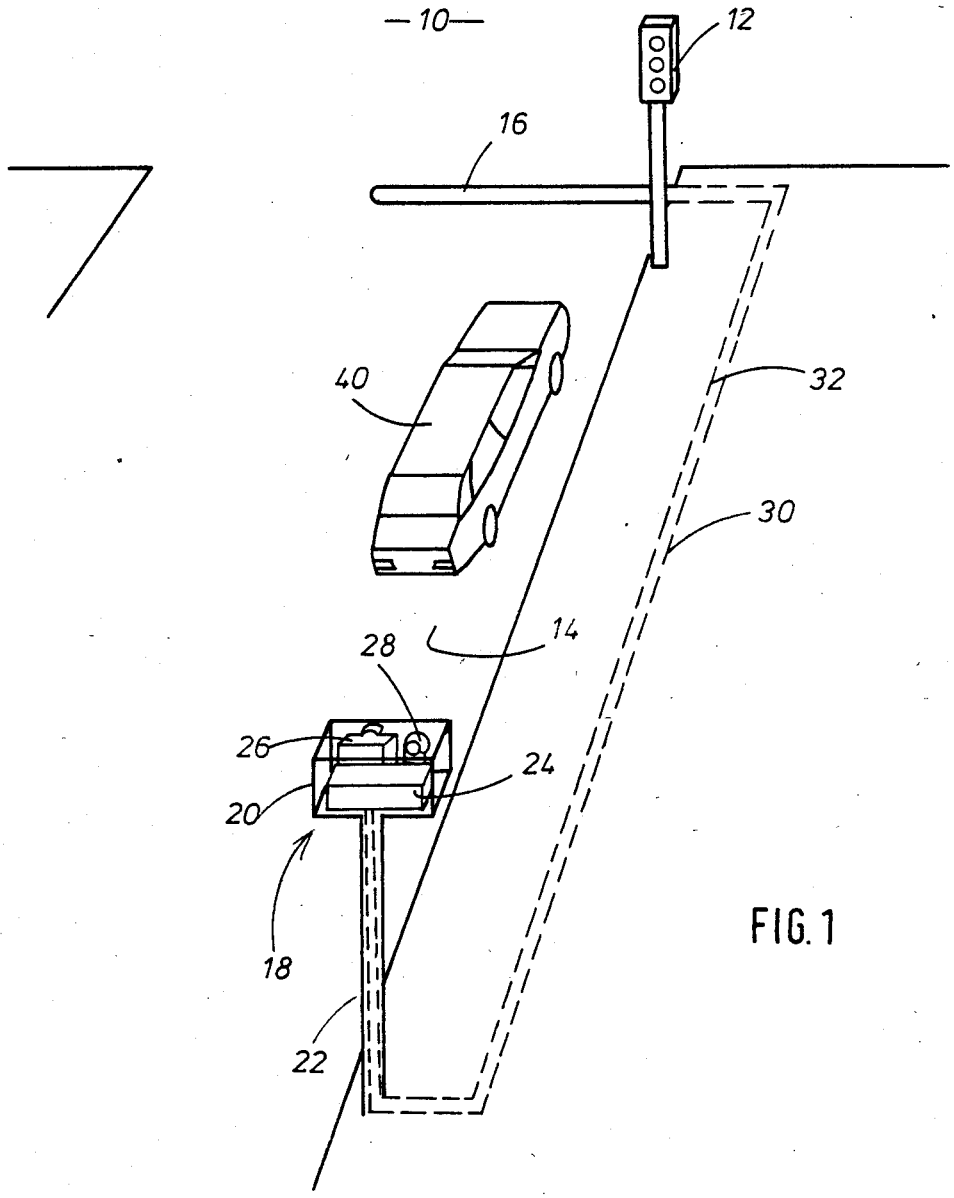
FIG. 1 is a schematic-perspective illustration and shows a device for photographic monitoring a road intersection controlled by a traffic light.

FIG. 1 is a schematic-perspective illustration of a road intersection 10, which is controlled by a traffic light 12. The other traffic lights of the road intersection are not shown in order to simplify the illustration. A sensor 16 in the form of an induction loop is imbedded in the road carpet of a road 14 joining the road intersection just before the junction with the road intersection 10. The sensor 16 responds when a vehicle 40 is driven thereover.

A device 18 for photographic monitoring of the road intersection 10 is arranged in a housing 20, which is arranged on a support 22 shortly spaced from the road intersection 10. The device 18 comprises a control and evaluation unit 24, a photographic camera 26 controlled by the control and evaluation unit and a flash light device 28. The control and evaluation unit 24 receives a sensor signal from the sensor 16 through a line 30 and a stop phase signal from the traffic light 12 through a line 32 when the traffic light changes to stop phase.

Figure 2:
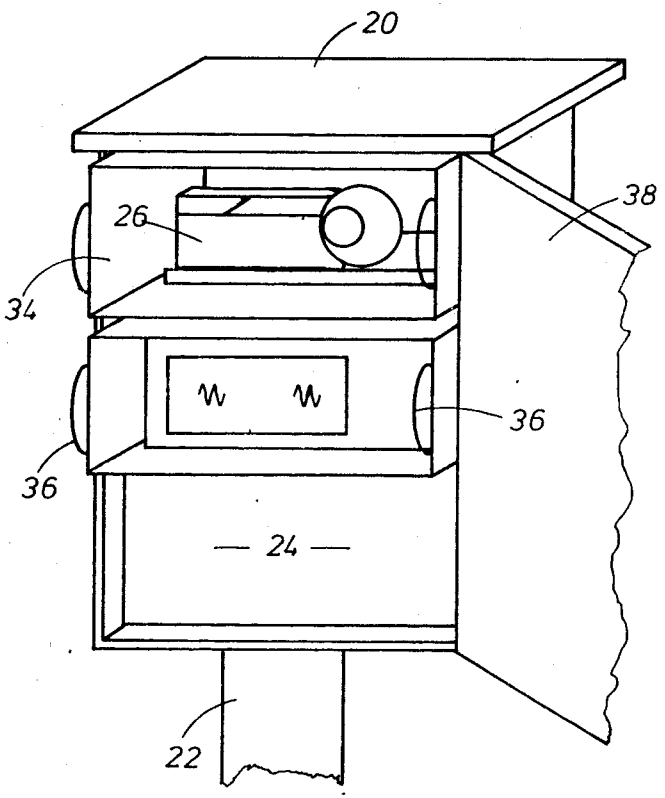
FIG. 2 is a schematic-perspective illustration and shows a housing stationarily mounted on a support or on a mast and having the rear wall open and an insert inserted therein, which insert is provided with camera and control and evaluation unit.

As can be seen from FIG. 2, the camera 26, the flash light device, and the control and evaluation unit are mounted in a housing-like insert 34. The insert 34 is adapted to be optionally pulled out of and re-inserted into the housing 20 by means of two handles 36. To this end, the rear wall 38 of the housing 20 can be opened as a door. Thus, with such an insert 34, it is possible to optionally equip several stationarily attached housings in a randomly irregular order or in a specific manner to meet particular needs.

Figure 3:
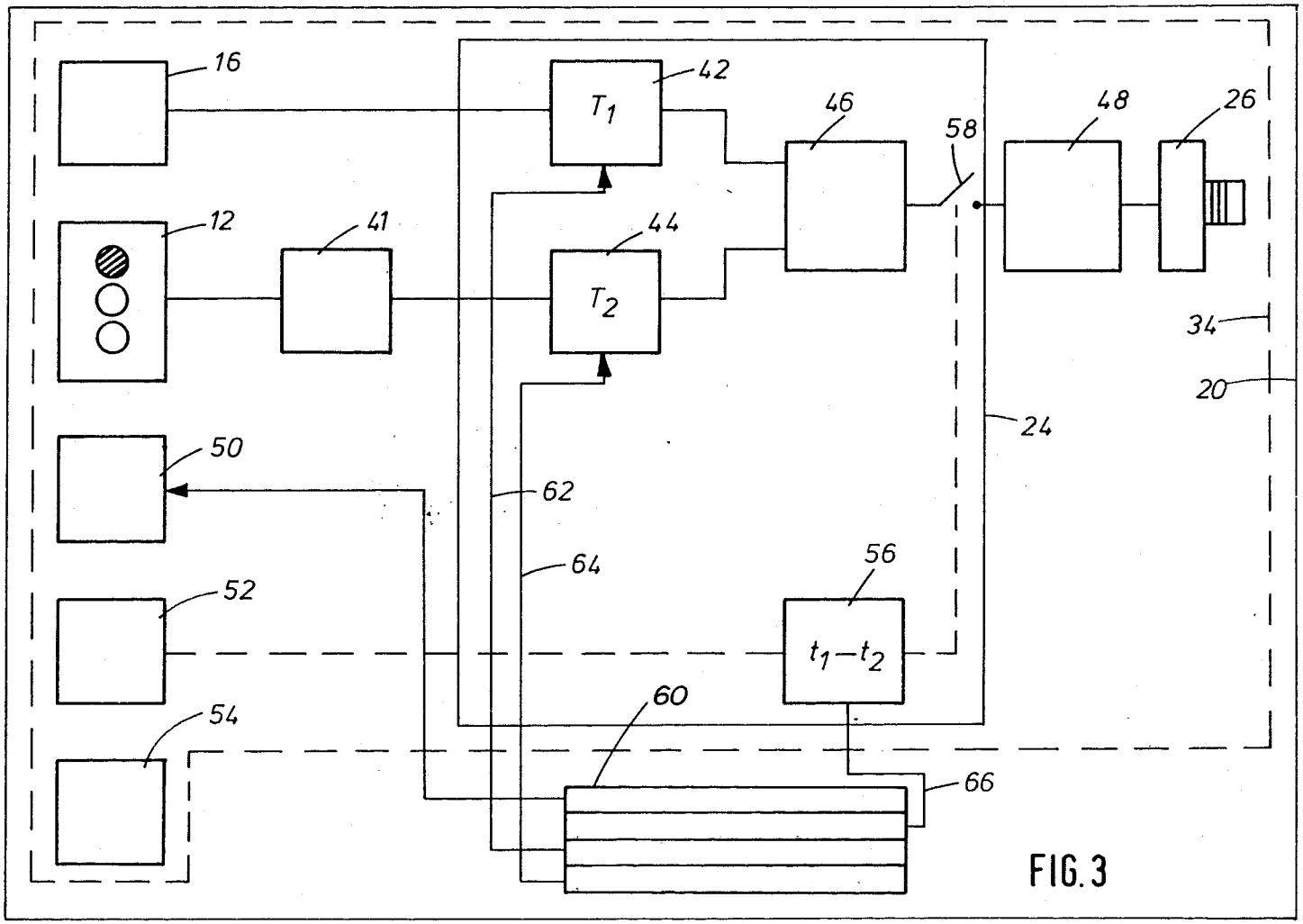
FIG. 3 is a block diagram of the device of FIGS. 1 and 2 and shows the co-action of the device with a semiconductor data carrier.

In FIG. 3 the device is illustrated in a block diagram. Also herein, numeral 12 designates the traffic light and numeral 16 designates the sensor imbedded in the road carpet. The traffic light 12 supplies a signal during the stop phase. This is illustrated by block 41. The signals from the sensor 16 and from the traffic light 12 can be delayed by times $T_1$ and $T_2$, respectively, by means of adjustable time function elements 42 and 44, respectively. Thereby differences between the different places of operation with respect to the position of the sensor 16 and the duration of the yellow phase, allowed tolerances or the like can be taken into account. The delayed signals are applied to a signal evaluation circuit 46 which practically corresponds to an AND-gate. Details of the circuit are left out for the sake of simplicity of the illustration. The signal evaluation circuit 46 controls a camera releaser 48. The camera releaser receives a releasing signal when a sensor signal is generated by the sensor 16 during the stop phase. The camera 26 is released by the camera releaser 48.

Then a picture is taken, which shows the road intersection with the traffic light showing stop phase and the vehicle 40 entering the road intersection. Furthermore, displays of an operation site indicator 50, a clock 52 and a date indicator 54 are reflected into the picture.

A time control 56 timed by the clock 52 can prevent releasing of the camera 26 at determined time intervals from $t_1$ to $t_2$. This is symbolized by a switch 58 between the signal evaluation circuit 46 and the camera releaser 48. The switch 58 is opened by the time control 56 during these time intervals. The time intervals during which no picture shall be taken depends on the operation site. They can, for example, be conditioned by the fact that the sun is shining into the objective of the camera 26 during this time such that no useful pictures can be taken.

The parameters $T_1$ and $T_2$ as well as the time interval $t_1$ to $t_2$ and eventually further parameters depending on the operation site are memorized in memory means 60 in the form of a semiconductor memory housing-fixedly mounted in the housing 20. These memory means 60 transmit the parameters to the control and evaluation unit 24. This is indicated by lines 62, 64 and 66 in FIG. 3.

Likewise, information about the operation site is transmitted from the memory means 60 to the operation site indicator 50. Thus, when the insert 34 is inserted into the housing 20, the device is automatically adjusted to the true parameters of the operation site and also the identification sign of the operation site is automatically input in the operation site indicator 50. The user does not have to adjust anything when changing-over. The data just has to be input once into the housing-fixed memory means, 60 associated with the housing 20.

Figure 4:
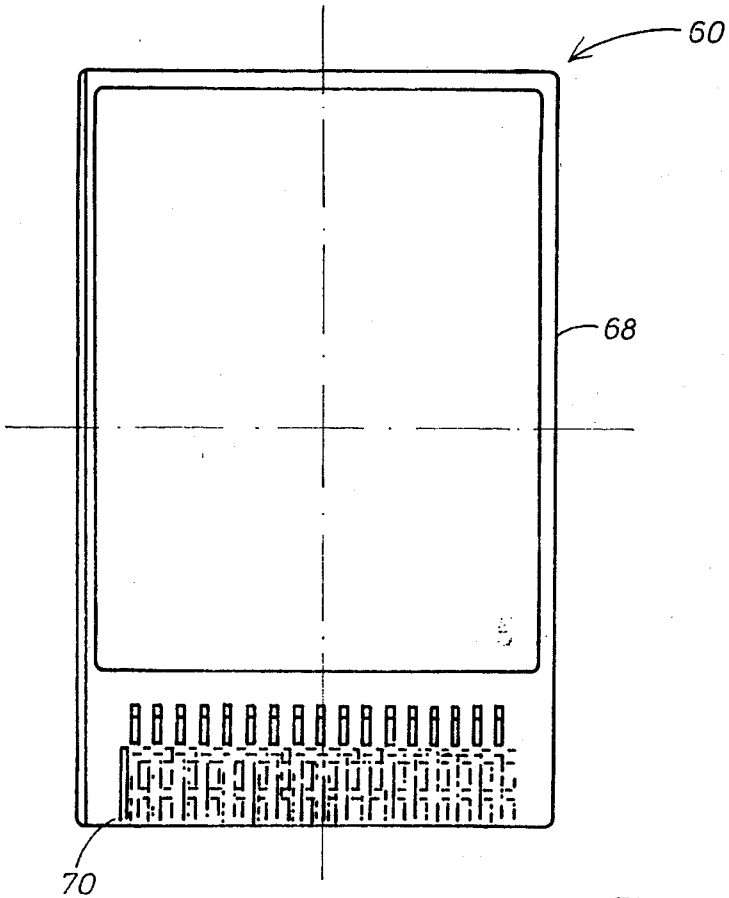
FIG. 4 shows a frontal view of a possible semiconductor data carrier.

FIG. 4 shows a semiconductor data carrier useful as memory means 60 in the form of a card-shaped integral switching circuit 68 (memory card) having a multiple plug 70. Memory cards are known per se and commercially available ("Elektronik" 19 (1986), 100–101).

However, other memory means can be used. In some cases the memory means can be formed by a coded plug or a coded plug bushing, which are attached to the housing 20 and make contact with a complementary counterpart of the insert 34 when the insert is inserted.

Figure 5:
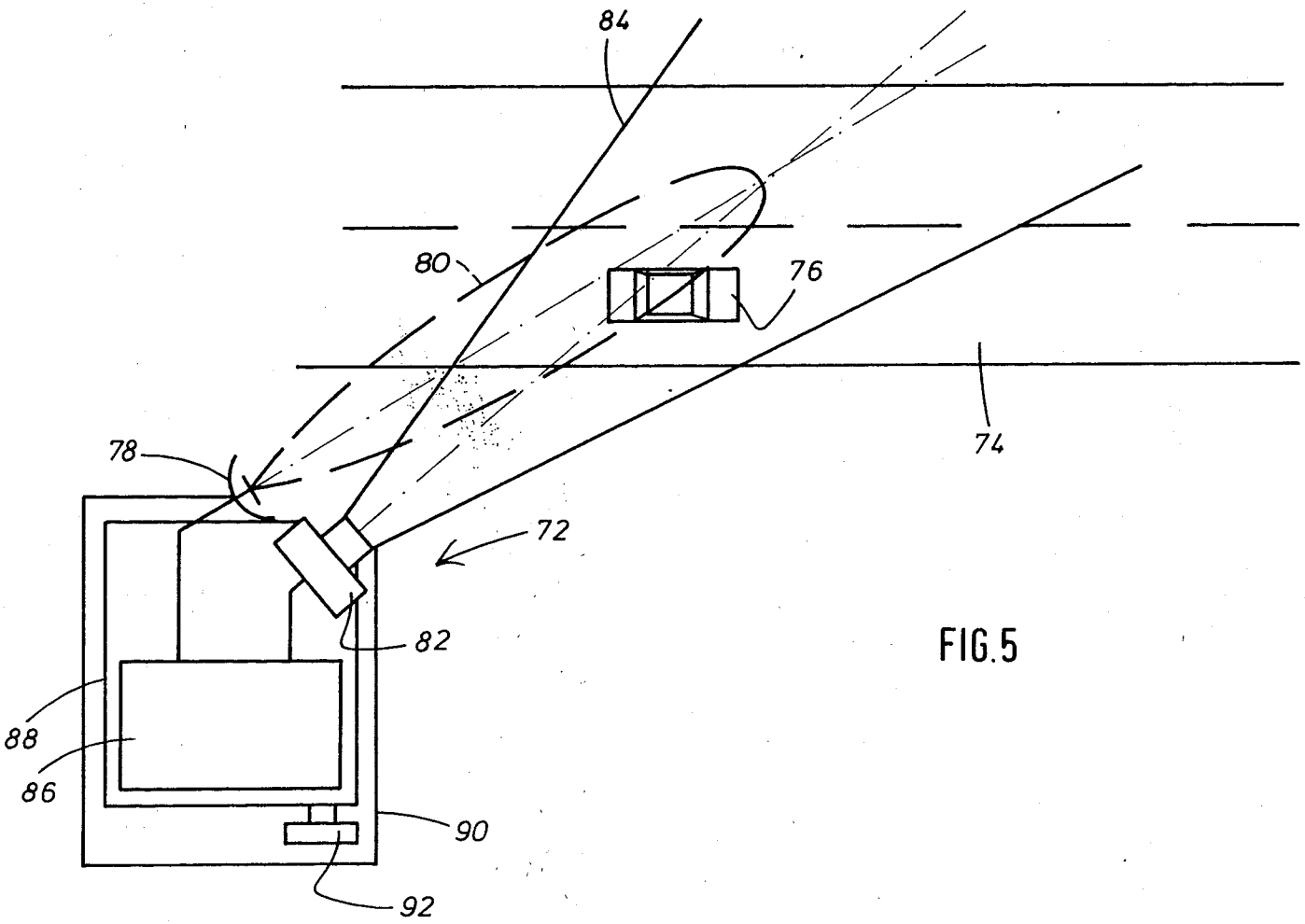
FIG. 5 is a schematic illustration of a speed monitoring device.

FIG. 5 shows a traffic monitoring device with which the speed of vehicles is monitored by means of a Doppler radar.

The device 72 is arranged laterally at the side of a road 74. Numeral 76 designates a vehicle to be monitored. The device 72 comprises a radar antenna 78 which emits a "radar lobe" 80. The "radar lobe" illustrates the emitted radiation energy per solid angle as a function of the angle. Furthermore, the device 72 comprises a photographic camera 82, which detects a field of view 84. The signal from the radar antenna 78 is applied to a measuring and evaluation circuit 86. The measuring and evaluation circuit 86 supplies a measuring value of the speed of the monitored vehicle 76 when the vehicle 76 has passed through the radar lobe 80. When the vehicle 76 exceeds an allowed maximum speed limit the camera 82 is released. Therein the camera 82 is released at a moment, in which the vehicle 76 is located substantially in the center of the field of view 84 of the camera 82.

The camera 82 and the measuring and evaluation circuit 86 are located together with indication devices in an insert 88. The insert 88 is, in turn, removably arranged in a stationary housing 90. A semiconductor memory 92 or a coded plug bushing is located in the housing 90. When the insert 88 is inserted into the housing 90 the semiconductor memory transmits to the measuring and evaluation circuit 86 parameters for the operation of the device at the special operation site. In particular, the memory supplies the maximum speed limit to be monitored at the operation site.

Figure 6:
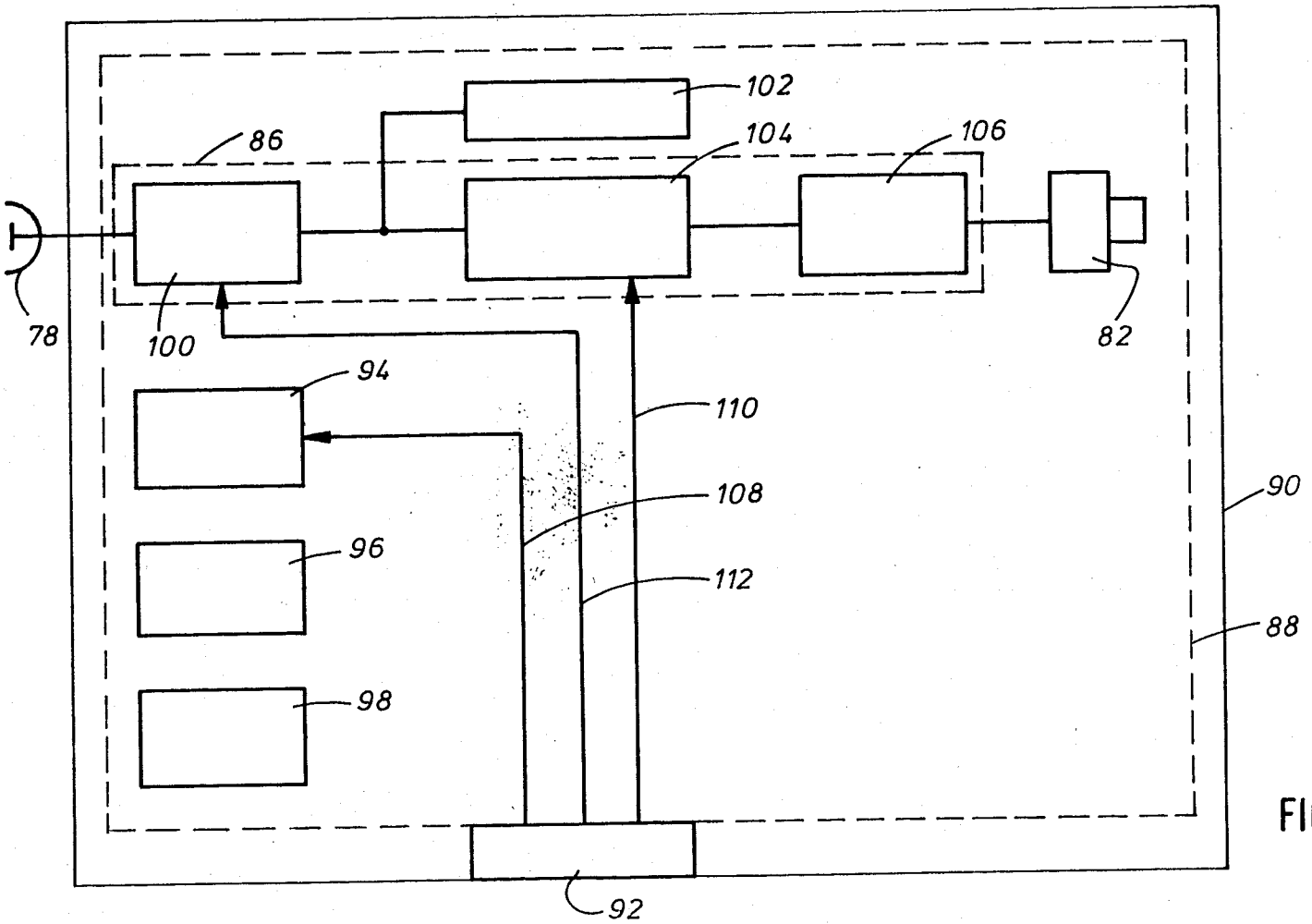
FIG. 6 is a block diagram of a device according to FIG. 5 and shows the co-action of the device with a semiconductor data carrier.

In FIG. 6 the construction and the function of the device is absolutely schematically illustrated in a block diagram. The camera 82, the measuring and evaluation circuit 86, an operation site indicator 94, a clock 96 and a date indicator 98 are arranged in the insert 88. The measuring and evaluation circuit 86 comprises a signal processing circuit 100, which forms a measuring value of the speed of the vehicle 76 from the radar signals. This measuring value is indicated by means of an indication device 102. Furthermore, it is compared with a predetermined maximum speed limit by means of a comparator 104. When the measuring value is larger than the upper speed limit, a releasing signal is applied to a releaser 106 and the camera 82 is released. The camera 82 takes a picture of the monitored vehicle 76, of the speed indication at the indication device 102 and of the operation site indication, the time and the date.

By means of memory means the operation site is transmitted to the operation site indicator 94 through data line 108. The allowed maximum speed limit valid at the operation site is given to the comparator 104 through line 110.

One single insert can also optionally be used for the speed monitoring as well as the monitoring of a road intersection controlled by a traffic light, which is described in connection with FIG. 1. The functions just differ in the signal processing. In this case, the program for the speed monitoring is called-in from the memory means through line 112.

I claim

1. A stationary traffic monitoring device comprising a housing fixedly installed at an operation site, and an insert having a recording camera and a control and evaluation unit adapted to receive data specific for the operation site, in which the data specific for the operation site are memorized in memory means, said memory means being adapted to transmit said data to the control and evaluation unit when the insert is inserted into the housing.

2. A stationary traffic monitoring device as claimed in claim 1, in which the memory means are formed by a semiconductor memory.

3. A stationary traffic monitoring device as claimed in claim 2, in which the semiconductor memory is formed by a card-shaped integral switching circuit.

4. A stationary traffic monitoring device as claimed in claim 1, in which the memory means comprise a coded plug.

5. A stationary traffic monitoring device as claimed in claim 1, in which the memory means comprise a program arranged to switch over the control and evaluation unit to a mode of operation (for example speed or red light monitoring) specific for the operation site.

* * * * *